US011585506B2

(12) United States Patent
Iwao et al.

(10) Patent No.: US 11,585,506 B2
(45) Date of Patent: Feb. 21, 2023

(54) VEHICLE LAMP BODY DEVICE

(71) Applicant: HONDA MOTOR CO., LTD., Tokyo (JP)

(72) Inventors: Shunsuke Iwao, Wako (JP); Daisuke Nakashima, Wako (JP); Hiroya Ohkubo, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/668,945

(22) Filed: Feb. 10, 2022

(65) Prior Publication Data

US 2022/0268412 A1 Aug. 25, 2022

(30) Foreign Application Priority Data

Feb. 19, 2021 (JP) ..... JP2021-025372

(51) Int. Cl.

| | |
|---|---|
| ***F21S 41/25*** | (2018.01) |
| ***F21S 43/27*** | (2018.01) |
| ***F21S 41/29*** | (2018.01) |
| ***F21S 43/20*** | (2018.01) |

(52) U.S. Cl.

CPC ..... *F21S 41/25* (2018.01); *F21S 41/29* (2018.01); *F21S 43/26* (2018.01); *F21S 43/27* (2018.01)

(58) Field of Classification Search

None

See application file for complete search history.

(56) References Cited

FOREIGN PATENT DOCUMENTS

| | | | | |
|---|---|---|---|---|
| DE | 102017115899 A1 * | 1/2019 | | |
| EP | 2012056 A1 * | 1/2009 | ..... | B60Q 1/2607 |
| JP | 2015-079627 | 4/2015 | | |

* cited by examiner

*Primary Examiner* — Elmito Breval

(74) *Attorney, Agent, or Firm* — Rankin, Hill & Clark LLP

(57) ABSTRACT

A turn light, a position light and a driving light are provided inside a same headlight unit, a first lens for which a first light source for the turn light and a second light source for the position light and the driving light are alternately arranged and a second lens which is arranged below the first lens and on which light from the first light source and the second light source is made incident are provided, a first diffusion part is provided on a light exit surface of the light of the first lens, and a second diffusion part is provided on a light exit surface of the light of the second lens.

5 Claims, 7 Drawing Sheets

VEHICLE LAMP BODY DEVICE

INCORPORATION BY REFERENCE

The present application claims priority under 35 U.S.C. § 119 to Japanese Patent Application No. 2021-025372 filed on Feb. 19, 2021. The content of the application is incorporated herein by reference in its entirety.

BACKGROUND OF THE INVENTION

Field of the Invention

The present invention relates to a vehicle lamp body device.

Description of the Related Art

A vehicle includes a vehicle lamp body device for irradiating an area around the vehicle.

As such a vehicle lamp body device, conventionally, a reflector of a position light extending in a vehicle width direction along an upper end of a headlight includes a plurality of slits arranged at predetermined intervals in the vehicle width direction, whereby a part other than the slits reflecting light looks bright and a part of the slits not reflecting the light looks dark so that a striped pattern gradation in which brightness changes in the vehicle width direction is formed at the position light and a design effect can be demonstrated. A technology capable of achieving the striped pattern gradation with high contrast, which cannot be achieved by just forming the reflector in a step shape, by a simple structure of forming the slits on the reflector without sticking a special film on a back surface of a lens has been disclosed (for example, see Japanese Patent Laid-Open No. 2015-079627).

SUMMARY OF THE INVENTION

In the conventional technology, the design effect can be demonstrated by forming the striped pattern gradation in which the brightness changes in the vehicle width direction at the position light.

However, in recent years, a light for which a turn light, a position light and a driving light are incorporated inside a headlight has been known.

In the case of such a light, when a light source is provided respectively for the turn light, the position light and the driving light, there is a problem that a manufacturing cost becomes high. In addition, while the turn light, the position light and the driving light radiate light from the light source in different orientations, a cut for changing the orientation with one headlight is needed and there are problems that it takes time and labor in processing and appearance is unattractive.

The present invention is implemented in consideration of points described above, and an object is to provide a vehicle lamp body device capable of making two lenses emit light by one light source and improving visibility and design by making orientations by the respective lenses be different.

In order to achieve the above-described object, according to an aspect of the present invention, in a vehicle lamp body device provided with a turn light, a position light and a driving light inside a same headlight unit, the device includes: a first lens for which a first light source for the turn light and a second light source for the position light and the driving light are alternately arranged; and a second lens which is arranged below the first lens and on which light from the first light source and the second light source is made incident, a first diffusion part is provided on a light exit surface of the light of the first lens, and a second diffusion part is provided on a light exit surface of the light of the second lens.

In the above-described configuration, the second lens includes a groove part which reflects and disperses the light from the first light source or the light from the second light source to an area of a light source which is not lighted.

In the above-described configuration, the first diffusion part and the second diffusion part are configured such that light distribution components are different.

In the above-described configuration, the first light source is made to sequentially emit light to be lighted with a time difference.

According to the aspect of the present invention, two of the first lens and the second lens can be made to emit light by the first light source and the second light source, it is not needed to respectively provide light sources for the first lens and the second lens and a cost can be reduced. In addition, light emitting expressions of the first lens and the second lens are made possible by the first diffusion part and the second diffusion part, visibility and design can be improved and a design effect can be also improved. Further, since the same first light source and second light source are used for the first lens and the second lens, lighting feeling irregularities are hardly caused.

DETAILED DESCRIPTION OF THE PREFERRED EMBODIMENT

Hereinafter, the embodiment of the present invention will be described with reference to the drawings. Note that, in description, right and left indicate the right and left based on an occupant of a vehicle and front and back indicate the front and back based on a vehicle advancing direction. In addition, in the figures, L indicates the left in a view from the occupant, R indicates the right in the view from the occupant, Up indicates an upper part and Dw indicates a down part.

Figure 1:
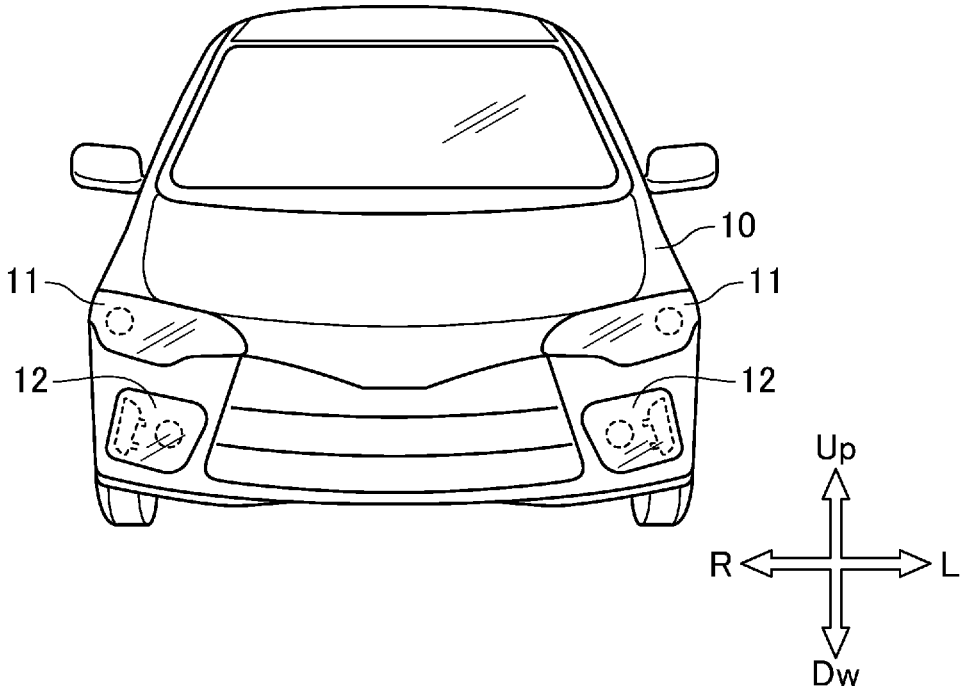
FIG. 1 is a front view of a vehicle to which a vehicle lamp body device of the present invention is applied.

FIG. 1 is a front view of a vehicle to which a vehicle lamp body device of the present invention is applied.

As illustrated in FIG. 1, at a front part of a vehicle body 10 configuring the vehicle, a headlight unit 11 where the vehicle lamp body device is housed is attached to the right and left of the vehicle body 10 respectively. Below each headlight unit 11, a fog lamp unit 12 is attached respectively.

The right and left headlight units 11 according to the present invention are formed in bilateral symmetry and a basic structure is the same. Hereinafter, one headlight unit 11 will be described in details as an example.

Figure 2:
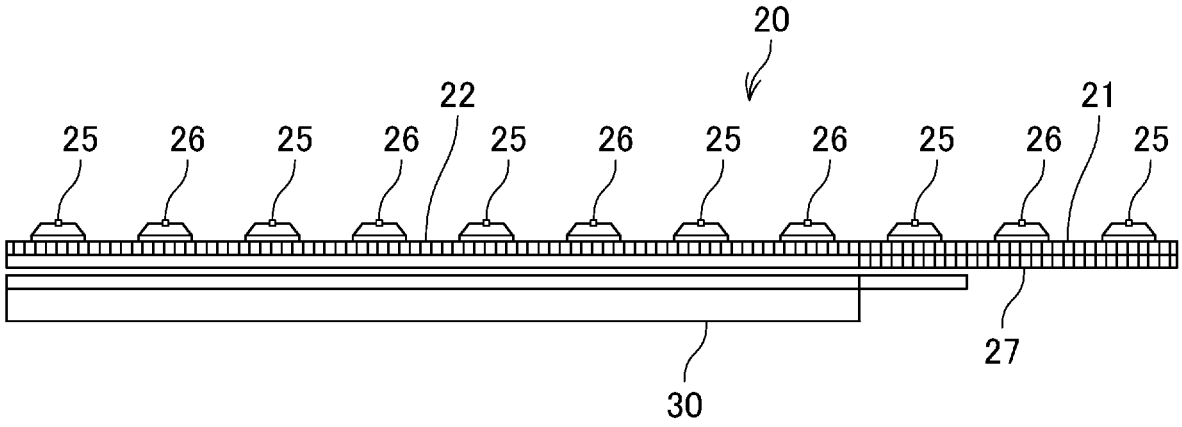
FIG. 2 is a front view illustrating an embodiment of the vehicle lamp body device according to the present invention.
Figure 3:
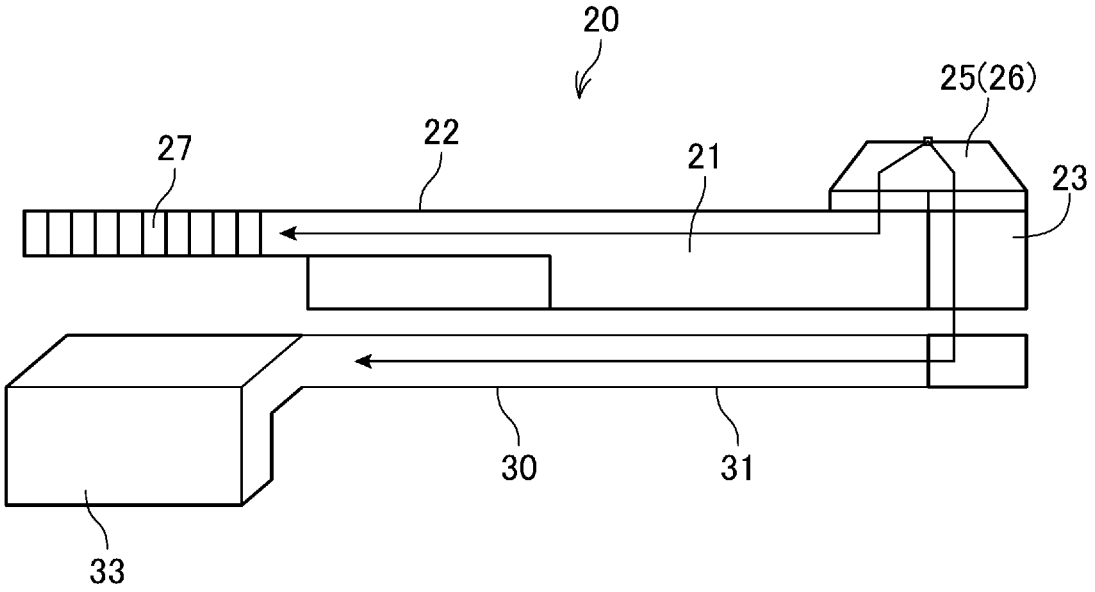
FIG. 3 is a side view illustrating the vehicle lamp body device of the present embodiment.
Figure 4:
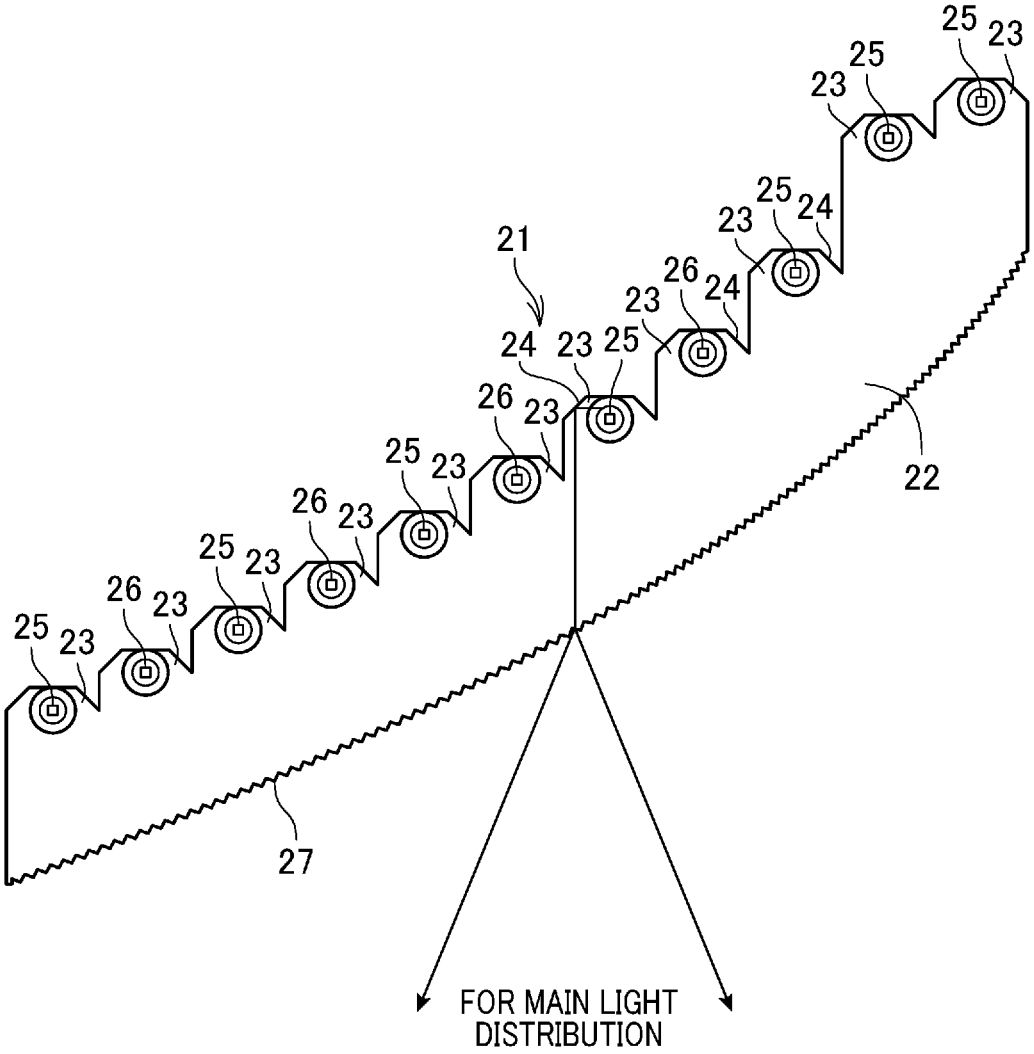
FIG. 4 is a plan view of a first lens in the present embodiment.
Figure 5:
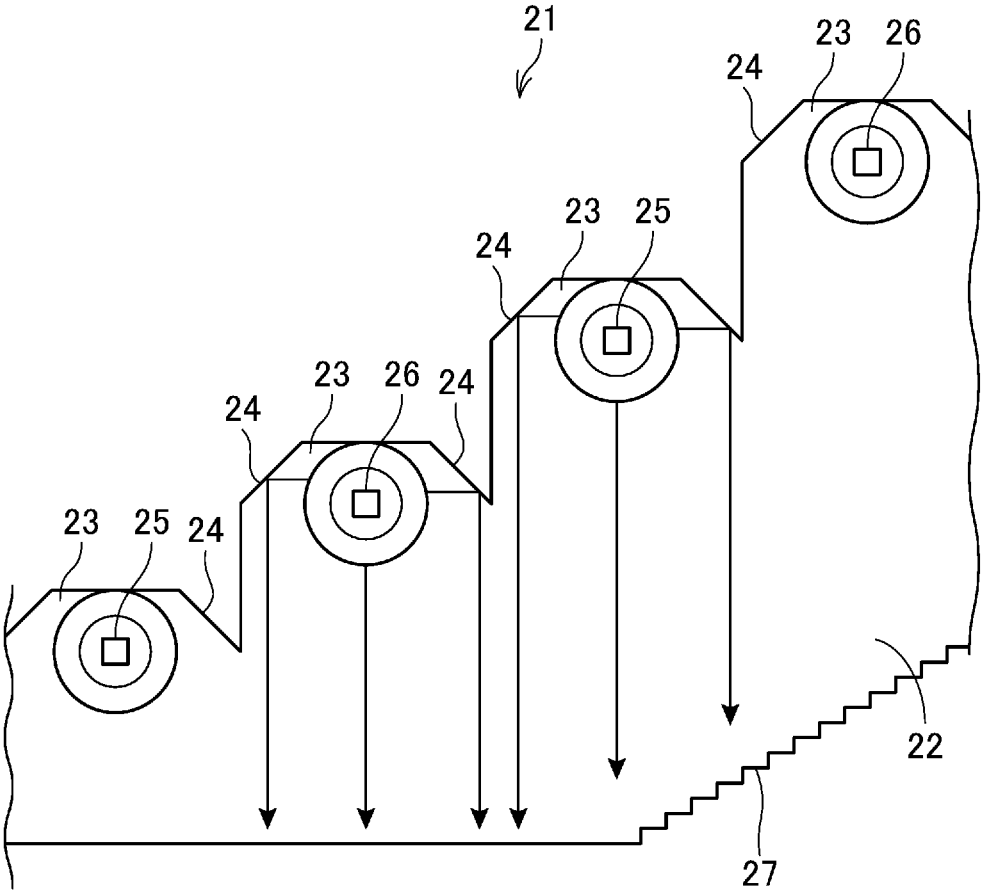
FIG. 5 is an enlarged plan view of the first lens in the present embodiment.
Figure 6:
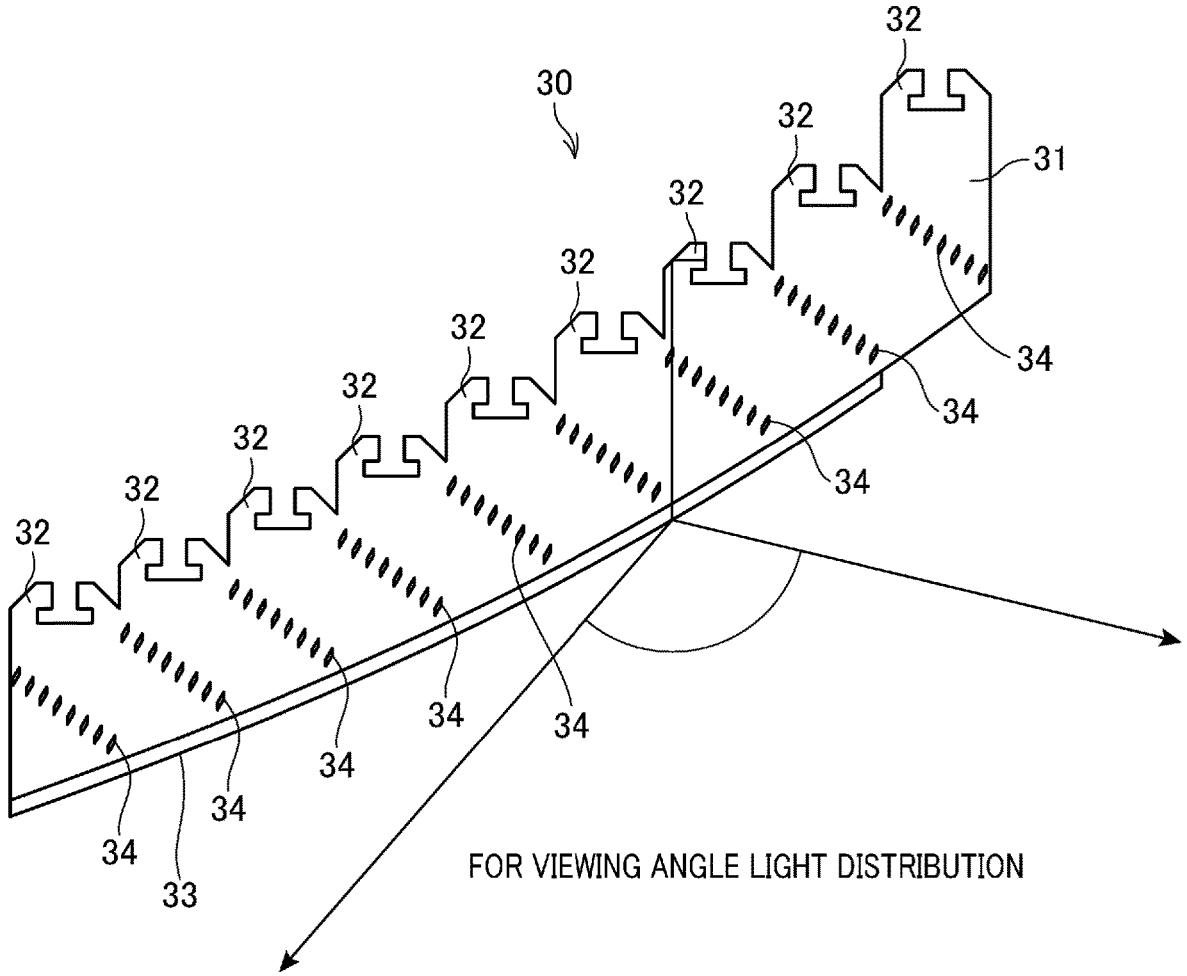
FIG. 6 is a plan view of a second lens in the present embodiment.
Figure 7:
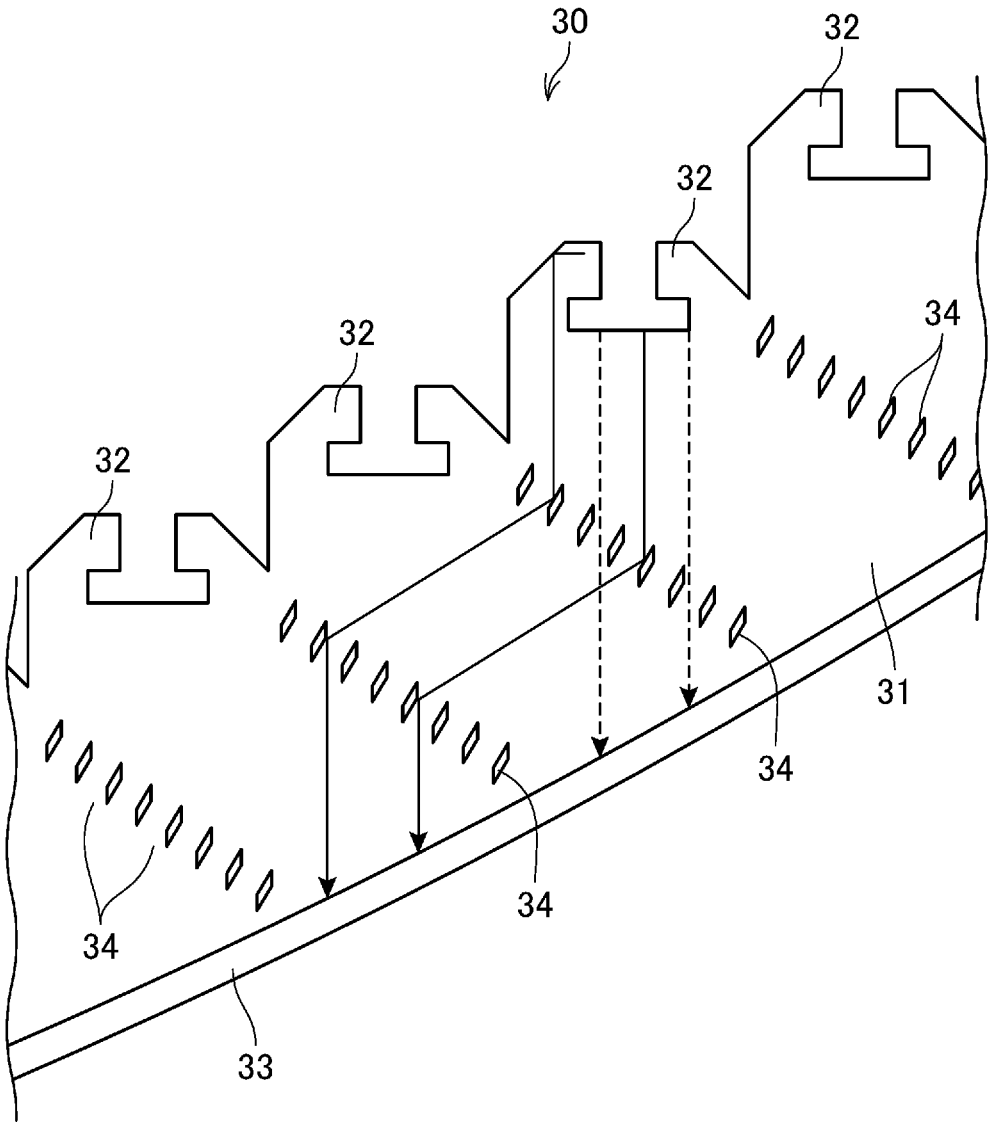
FIG. 7 is an enlarged plan view of the second lens in the present embodiment.

FIG. 2 is a front view illustrating the embodiment of the vehicle lamp body device according to the present invention. FIG. 3 is a side view illustrating the vehicle lamp body device of the present embodiment. FIG. 4 is a plan view of a first lens 21 in the present embodiment. FIG. 5 is an enlarged plan view of the first lens 21 in the present embodiment. FIG. 6 is a plan view of a second lens 30 in the present embodiment. FIG. 7 is an enlarged plan view of the second lens 30 in the present embodiment.

As illustrated in FIG. 2 and FIG. 3, in the present embodiment, a vehicle lamp body device 20 is housed inside the headlight unit 11. The vehicle lamp body device 20 includes the first lens 21 and the second lens 30.

As illustrated in FIG. 4, the first lens 21 includes a light-transmissive first body part 22 formed in an arc shape having a predetermined length in a lateral direction.

At a rear end edge of the first body part 22, a plurality of light source holding parts 23 formed in a projected shape are arrayed along a lateral width direction of the first body part 22.

Each of the light source holding parts 23 includes a reflection surface 24 configured by a plurality of slopes.

To each of the light source holding parts 23, a first light source 25 and a second light source 26 are alternately attached. The first light source 25 and the second light source 26 are configured by a light emitting element such as an LED for example, and the first light source 25 and the second light source 26 are provided so as to emit light downwards.

The first light source 25 is a light source which develops yellow for example, and the second light source 26 is a light source which develops white for example.

That is, the first light source 25 is used as a turn light and the second light source 26 is used as a position light and a driving light.

At a front end edge of the first body part 22, a first diffusion part 27 where roughly triangular minute projections and recesses are formed is formed. Here, an orientation range by the first diffusion part 27 is configured to be a relatively narrow range.

The orientation by the first body part 22 is a main light distribution component.

As illustrated in FIG. 5, when the first light source 25 is lighted, the light from the first light source 25 is radiated to a front end of the first body part 22 by a route of being directly radiated toward the front end of the first body part 22 and a route through which the light from the first light source 25 is reflected by the individual reflection surface 24 and radiated toward the front end of the first body part 22.

The light radiated to the front end of the first body part 22 is made to exit from the first body part 22 while being diffused by the first diffusion part 27.

In addition, in a case of lighting the second light source 26, similarly to the case of the first light source 25, the light from the second light source 26 is radiated to the front end of the first body part 22 by the route of being directly radiated toward the front end of the first body part 22 and the route through which the light from the second light source 26 is reflected by the individual reflection surface 24 and radiated toward the front end of the first body part 22, and the light is made to exit from the first body part 22 while being diffused by the first diffusion part 27.

The second lens 30 includes a second body part 31 positioned below the first body part 22.

As illustrated in FIG. 6, the second body part 31 is also formed in the arc shape having a predetermined width in a front-back direction similarly to the first body part 22.

At a rear end edge of the second body part 31, light incident parts 32 on which the light radiated from the first light source 25 and the second light source 26 is made incident are formed at positions corresponding to the light source holding parts 23 of the first body part 22.

The light radiated from the first light source 25 and the second light source 26 is emitted to a lower part of the light source holding parts 23 of the first body part 22 and made incident on the second body part 31 from the light incident parts 32.

On a front end edge of the second body part 31, a second diffusion part 33 is provided. A range of a diffusion orientation by the second diffusion part 33 is configured to be the range wider than the range of the orientation by the first diffusion part 27.

The orientation by the second body part 31 is a viewing angle light distribution component for which the range of the orientation is wide.

As illustrated in FIG. 6 and FIG. 7, the second body part 31 is provided with a plurality of groove parts 34 arrayed obliquely from the light incident parts 32 to the front end edge of the second body part 31.

The individual groove part 34 is arrayed so as to form a column for each individual light incident part 32. That is, the groove parts 34 of the second body part 31 are configured to reflect and disperse the light from the first light source 25 or the light from the second light source 26 to the area of the light source which is not lighted.

As illustrated by a broken line in FIG. 7, part of the light which is made incident from the light incident part 32 and passes through inside of the second body part 31 passes through a gap of the individual groove part 34 and is directly radiated toward the front end edge of the second body part 31. In addition, part of the light which is made incident from the light incident part 32 and passes through the inside of the second body part 31 is, as illustrated by a solid line in FIG. 7, reflected on an outer surface of the individual groove part 34 and reflected toward the groove part 34 of the adjacent column. The light reflected at the groove part 34 is reflected again at the groove part 34 of the adjacent column and radiated toward the front end edge of the second body part 31.

As described above, while the first light source 25 and the second light source 26 are alternately arranged at the light source holding parts 23 of the first body part 22 in the present embodiment, for example, in the case where only the first light source is lighted and the light radiated from the first light source 25 is made incident on the light incident part 32, by reflecting the incident light at the groove part 34, the light from the first light source 25 can be sent also to the area corresponding to the adjacent light incident part 32.

Thus, roughly uniform light can be emitted over the entire area in the lateral direction of the front end edge of the second body part 31.

Next, an effect of the present embodiment will be described.

First, when the first light source 25 is lighted, the light from the first light source 25 is radiated toward the front end edge of the first body part 22 and is made to exit from the first body part 22 while being diffused by the first diffusion part 27.

On the other hand, part of the light from the first light source 25 is made to exit from the lower part of the light source holding parts 23 and is made incident on the inside of the second body part 31 from the light incident part 32 of the second body part 31.

Part of the light which is made incident from the light incident part 32 and passes through the inside of the second body part 31 passes through the gap of the individual groove part 34 and is directly radiated toward the front end edge of the second body part 31. The other part of the light passing through the inside of the second body part 31 is reflected on the outer surface of the individual groove part 34, reflected toward the groove part 34 of the adjacent column, reflected again at the groove part 34 of the adjacent column, radiated toward the front end edge of the second body part 31, and made to exit from the second body part 31 while being diffused by the second diffusion part 33.

In such a manner, by lighting the first light source 25, white light can be made to exit respectively from the front end edge of the first body part 22 and the front end edge of the second body part 31. In this case, the first body part 22 is oriented by the main light distribution component, the second body part 31 is oriented by the viewing angle light distribution component, and different orientation control is performed for the first body part 22 and the second body part 31. Therefore, a lighting performance can be viewed differently from outside. Thus, visibility from the outside can be improved.

Since the first light source 25 functions as the turn light, for example, by lighting the individual first light source 25 with a time difference, the first light source 25 can be made to flicker as if flowing from a center side to an outer side of the vehicle body 10, and the visibility can be improved.

In addition, also in the case of lighting the second light source 26, similarly to the case of the first light source 25, the light from the second light source 26 is radiated toward the front end edge of the first body part 22 and is made to exit from the first body part 22 while being diffused by the first diffusion part 27.

On the other hand, part of the light from the second light source 26 is made incident on the inside of the second body part 31 from the light incident part 32 of the second body part 31, and part of the light which is made incident from the light incident part 32 and passes through the inside of the second body part 31 passes through the gap of the individual groove part 34 and is directly radiated toward the front end edge of the second body part 31. The other part of the light passing through the inside of the second body part 31 is reflected on the outer surface of the individual groove part 34, reflected toward the groove part 34 of the adjacent column, reflected again at the groove part 34 of the adjacent column, radiated toward the front end edge of the second body part 31, and made to exit from the second body part 31 while being diffused by the second diffusion part 33.

In such a manner, by lighting the second light source 26, yellow light can be made to exit respectively from the front end edge of the first body part 22 and the front end edge of the second body part 31.

Since parallel light radiated from the first light source 25 and the second light source 26 is utilized, distributed light components can be diffused with pinpoint accuracy and it is efficient.

In addition, since the parallel light of the same first light source 25 and second light source 26 is utilized in a light emitting area in the first body part 22 and the second body part 31, lighting feeling irregularities are hardly caused.

Further, while the first light source 25 which functions as the turn light and the second light source 26 which functions as the position light and the driving light are alternately arranged, by a structure provided with the groove parts 34, the same plane of the light emitting area in the second body part 31 can be made to emit light.

As described above, in the present embodiment, the turn light, the position light and the driving light are provided inside the same headlight unit 11, the first lens 21 for which the first light source 25 for the turning light and the second light source 26 for the position light and the driving light are alternately arranged and the second lens 30 which is arranged below the first lens 21 and on which the light from the first light source 25 and the second light source 26 is made incident are provided, the first diffusion part 27 is provided on the light exit surface of the light of the first lens 21, and the second diffusion part 33 is provided on the light exit surface of the light of the second lens 30.

Thus, the first light source 25 and the second light source 26 can make the two of the first lens 21 and the second lens 30 emit the light, it is not needed to respectively provide the light sources for the first lens 21 and the second lens 30 and a cost can be reduced. In addition, by the first diffusion part 27 and the second diffusion part 33, light emitting expressions of the first lens 21 and the second lens 30 are made possible, the visibility can be improved and a design effect can be also improved. Further, since the same first light source 25 and second light source 26 are used for the first lens 21 and the second lens 30, the lighting feeling irregularities are hardly caused.

In addition, in the present embodiment, the second lens 30 includes the groove parts 34 which reflect and disperse the light from the first light source 25 or the light from the second light source 26 to the area of the light source which is not lighted.

Thus, lighting by the first light source 25 or the second light source 26 can be performed at the first lens 21 and the roughly uniform light can be emitted over the entire area in the lateral direction at the second lens 30.

In the present embodiment, the first diffusion part 27 and the second diffusion part 33 are configured such that the light distribution components are different.

Thus, the lighting performance can be viewed differently between the first lens 21 and the second lens 30 from the outside and the visibility from the outside can be improved. In addition, the need of partial cutting and shape change for viewing angle light distribution in one headlight unit is eliminated, manufacture is facilitated, and adverse effects on the appearance during non-lighting and the lighting feelings can be suppressed.

In addition, in the present embodiment, the first light source 25 is made to sequentially emit the light to be lighted with a time difference.

Thus, the first light source 25 which functions as the turn light can be made to flicker as if flowing and the visibility can be improved.

Further, as a different embodiment, for example, in the case of not including the groove parts 34 in the second body part 31, the light from the first light source 25 or the second light source 26 emitted from the first lens 21 is emitted from the second lens 30 in the same area as a lighting position at the first lens 21.

Thus, the structure of the second body part 31 can be simplified.

The embodiment of the present invention has been described above, and various design changes can be performed for the present invention without deviating from the gist.

REFERENCE SIGNS LIST

10 Vehicle body
11 Headlight unit

12 Fog lamp unit
20 Vehicle lamp body device
21 First lens
22 First body part
23 Light source holding part
24 Reflection surface
25 First light source
26 Second light source
27 First diffusion part
30 Second lens
31 Second body part
32 Light incident part
33 Second diffusion part
34 Groove part

What is claimed is:

1. A vehicle lamp body device provided with a turn light, a position light and a driving light inside a same headlight unit, wherein a front and back direction, a vertical direction, and a width direction correspond to a front and back direction of a vehicle, a vertical direction of the vehicle, and a width direction of the vehicle when the device is in use and mounted on the vehicle, wherein the device comprising:

a first lens for which a first light source for the turn light and a second light source for the position light and the driving light are alternately arranged; and a second lens which is arranged below the first lens and on which light from the first light source and the second light source is made incident, wherein the first lens includes a first body part having a predetermined length in the width direction, the first light source and the second light source are attached to a plurality of light source holding parts formed along the width direction at a rear end edge of the first body part in the front and back direction so as to emit light downward, the second lens includes a second body part positioned below the first body part and having a predetermined length in the width direction, at a rear end edge of the second body part in the front and back direction, light incident parts on which the light radiated from the first light source and the second light source is made incident are formed at positions corresponding to the light source holding parts of the first body part, a first diffusion part is provided on a front end surface of the first lens, which is a light exit surface of the light of the first lens and a second diffusion part is provided on a front end surface of the second lens, which is a light exit surface of the light of the second lens.

2. The vehicle lamp body device according to claim 1, wherein the second lens comprises a groove part which reflects and disperses the light from the first light source or the light from the second light source to an area of a light source which is not lighted.

3. The vehicle lamp body device according to claim 1, wherein the first diffusion part and the second diffusion part are configured such that light distribution components are different.

4. The vehicle lamp body device according to claim 1, wherein the first light source is made to sequentially emit light to be lighted with a time difference.

5. The vehicle lamp body device according to claim 1, wherein the second body part is provided with a plurality of groove parts arranged obliquely from the light incident parts to the front end edge in the front and back direction so as to form a column for each individual light incident part.

* * * * *